US005513570A

United States Patent [19]

Mulcahy

[11] Patent Number: 5,513,570

[45] Date of Patent: May 7, 1996

[54] PRESSURE ACTUATED PIPE CUTTING TOOL

[75] Inventor: Patrick M. Mulcahy, Missouri City, Tex.

[73] Assignee: Western Atlas International, Inc., Houston, Tex.

[21] Appl. No.: 391,131

[22] Filed: Feb. 21, 1995

[51] Int. Cl.[6] ..... F42B 3/00; E21B 27/02

[52] U.S. Cl. ..... 102/312; 102/313; 166/63; 299/13

[58] Field of Search ..... 102/312, 313; 166/63; 299/13

[56] References Cited

U.S. PATENT DOCUMENTS

| | | | |
|---|---|---|---|
| 3,253,653 | 5/1966 | Layne, Sr. | 102/313 X |
| 3,374,735 | 3/1968 | Moore | 102/313 |
| 3,590,738 | 7/1971 | Holzman | 102/313 |
| 4,339,000 | 7/1982 | Cronmiller | 166/295 |
| 5,031,540 | 7/1991 | Kenny | 102/312 X |
| 5,239,316 | 11/1993 | Nelson et al. | 102/312 X |
| 5,308,149 | 5/1994 | Watson et al. | 299/13 |
| 5,467,824 | 11/1995 | DeMarsh et al. | 166/297 |

OTHER PUBLICATIONS

Brochure: Pipe Recovery Guide: Advanced Technology for Fast, Effective Pipe Recovery, Western Atlas International, Inc., U.S.A., 1989.

Brochure: JRC Drill Collar Severing Tool, Jet Research Center, Inc. (U.S.A.).

*Primary Examiner*—Peter A. Nelson

*Attorney, Agent, or Firm*—Richard A. Fagin

[57] ABSTRACT

The present invention is a system for severing pipe. The system includes an explosively actuated pipe cutter, a pressure actuated initiator, and a means for suspending the cutter and the initiator inside the pipe and pressure sealing the interior of the pipe.

In a particular embodiment of the invention, the initiator includes a time delay to enable reduction in pressure applied to the interior of the pipe for actuating the initiator.

8 Claims, 3 Drawing Sheets

PRESSURE ACTUATED PIPE CUTTING TOOL

FIELD OF THE INVENTION

The present invention is related to the field of recovery of pipe from boreholes drilled into the earth. More specifically, the present invention is related to a system for severing pipe in a borehole so that the pipe can be recovered.

DESCRIPTION OF THE RELATED ART

Boreholes are commonly drilled into subterranean formations for the purpose, among others, of extracting oil and gas. Boreholes are typically drilled with a device called a rotary drilling rig, which applies rotary motion to a cutting instrument, or drill bit, which penetrates the subterranean formations. The drill bit is pushed to a lo desired depth by means of a pipe formed from threadedly connected sections. The pipe, together with other instruments which may be attached to the bottom end of the pipe for drilling the borehole in a desired trajectory, are collectively called a drillpipe or drillstring.

Some subterranean formations can be sensitive to the drilling process, or they may lack mechanical integrity. A sensitive formation can occasionally swell or slough into the open borehole. If the sloughing or swelling is severe enough, the drillpipe may become lodged in the borehole in such a way as to make further drilling, or removal of the drillpipe from the borehole, impossible.

If it is determined that removal of the drillpipe is impossible because it has become stuck, it is often desirable to attempt to remove as much of the drillpipe as possible from the borehole. Removal of the greatest possible amount of drillpipe from the borehole both reduces the amount of drillpipe abandoned in the borehole, and reduces the amount of borehole that would have to be drilled again if the borehole owner should choose to attempt to redrill the borehole to the same target subterranean formation which was previously intended.

After a borehole is drilled to the target subterranean formation, a protective pipe, called a casing, is typically set into the borehole to a predetermined depth. The casing is used to form an hydraulic seal between different subterranean formations penetrated by the borehole. Sometimes while the casing is being lowered into the borehole it can become stuck from some of the same causes which can cause the drillpipe to become stuck. In order to complete the borehole it is typically necessary to remove as much casing as possible and redrill the borehole to the depth of the target formation.

In other boreholes which have produced substantially all of the economically recoverable oil and gas from the subterranean formations penetrated by those boreholes, the borehole operator may wish to attempt to salvage some of the casing before plugging and abandoning the borehole.

In still other boreholes, an additional pipe can be inserted coaxially inside the casing. The additional pipe is called a tubing string. The tubing string generally serves the purpose of increasing the velocity of fluids flowing up the borehole so that more dense components of the fluid, such as water, will become entrained in the fluid flow and be carried to the earth's surface, thereby reducing hydrostatic head opposing the entry of fluids into the borehole. When a borehole having a tubing string is to be recompleted into a different formation or is to be abandoned, it is usually necessary to remove the tubing string from the borehole. Occasionally the tubing string can become stuck in the borehole thereby preventing the removal of the tubing string from the borehole.

In all of the situations described herein in which the pipe becomes stuck in the borehole it may prove necessary to sever the pipe above the point at which it is stuck in order to enable recovery of the portion of the pipe which is not stuck.

A tool known in the art for severing pipe in a borehole is called a jet cutter. A jet cutter comprises a charge of high explosive compound shaped in such a way as to create a "jet" of high pressure, high temperature gas which is directed circumferentially from inside the pipe to cut the pipe. A jet cutter is described, for example, in "Pipe Recovery Guide", Atlas Wireline Services, Houston, Tex., 1987 (p. 24).

Another tool known in the art for severing pipe in a borehole is called a "severing tool". A typical severing tool is disclosed in "JRC Drill Collar Severing Tool", Jet Research Center, Inc., Alvarado, Tex., 1991. The severing tool comprises a plurality of high explosive charges adapted to detonate is a coordinated sequence to generate an extremely powerful cutting jet.

Both the severing tool and the jet cutler are typically actuated by an electrically powered initiator called a blasting cap. The jet cutter or severing tool, and the blasting cap are typically lowered inside the pipe, as an assembly, on one end of an armored electrical cable to a depth just above which the pipe is stuck. Equipment at the earth's surface which is connected to the other end of the cable, under control of the system operator imparts a detonating voltage to the cable which initiates the blasting cap and subsequently the jet cutter. At the same time, the drilling rig typically will be operated so as to impart rotary torque and vertical (axial) lifting stress to the pipe. Usually upon detonation of the cutter, the pipe which is above the cutter comes free.

A drawback to the system for severing pipe known in the art using the electrically actuated pipe cutters described herein is the need to actuate the cutter by means of the detonation voltage sent over the electrical cable. In certain cases cutting the pipe while the axial stress is applied to it results in "backlash ", whereby the stress is relieved by abrupt upward motion of the pipe. Backlash can cause the electrical cable to become tangled or severed, making it difficult or impossible to recover any equipment remaining inside the pipe at the end of the cable.

It is an object of the present invention to provide a pipe cutter which can be actuated without application of a detonating voltage.

It is a further object of the present invention to provide a method of pipe recovery which enables removal of the electrical cable from the borehole before actuating the cutter.

SUMMARY OF THE INVENTION

The present invention is a system for severing pipe. The system includes an explosively actuated pipe cutter, a pressure actuated initiator, and a means for suspending the cutter and the initiator inside the pipe and pressure sealing the interior of the pipe.

In a particular embodiment of the invention, the initiator includes a time delay to enable reduction in pressure applied to the interior of the pipe for actuating the initiator.

DESCRIPTION OF THE PREFERRED EMBODIMENT

Figure 1:
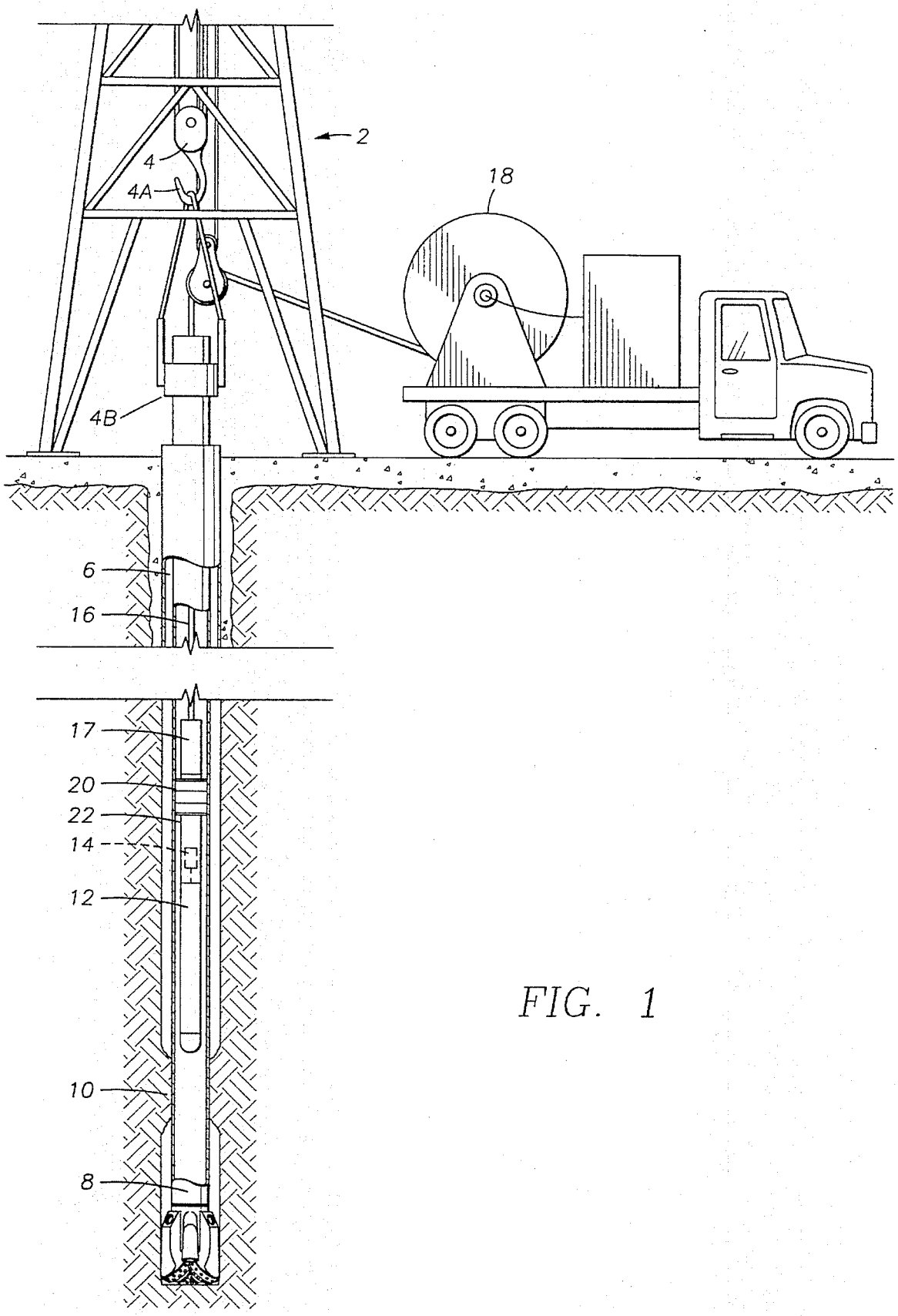
FIG. 1 shows the system of the present invention being lowered into a stuck pipe by means of an electrical cable.

Operation of the present invention can be better understood by referring to FIG. 1. A borehole 8 is drilled using a pipe 8 lowered in to the earth by a drilling rig 2. In FIG. 1 the pipe 8 is shown as being lodged because of sloughing of the wall of the borehole 6, as shown generally at 10.

The drilling rig 2 includes equipment shown as a block 4, a hook, 4A and elevators 4B which normally is used to rotate the pipe 8, and to move the pipe 8 into and out of the borehole 6. When the pipe 8 is stuck, however, the rig 2 and equipment 4, 4A, 4B can only apply stress to the pipe 8, since the pipe is immobilized by the sloughing 10.

A wireline unit 18 positioned near the rig 2 is used to convey the apparatus of the present invention into the interior of the pipe 8 to the depth at which the pipe 8 is to be severed, as will be further explained.

The wireline unit 18 comprises an armored electrical cable 16 which is unreeled by winch equipment (not shown separately) forming part of the wireline unit 18. A wireline operated hydraulic setting tool 17 is attached to one end of the cable 16. The setting tool 17 is used to set an annular seal 20, called a packer, upon control of the system operator when the packer 20 is positioned near the depth at which the pipe 8 is to be severed. The method of determining the depth of the packer 20 is known to those skilled in the art. The setting tool 17 can be of a type known in the art such one made by Baker Oil Tools, Inc. and sold under model designation "10". The packer 20 can be of a type known in the art, for example one made by Baker Oil Tools, Inc. and sold under model designation "FA". The packer 20 should be selected so that the so-called "setting diameter", which is a range of values of the external diameter of the packer 20 after it is operated by the setting tool 17, includes the inside diameter of the pipe 8.

While the present embodiment of the invention is directed to the use of a packer 20 which is set by means of a wireline setting tool 17, it is contemplated that the present invention can also include a compression-set packer, such as those made by Baker Oil tools, Inc. and sold under model designations "FB-1" and "DB", to be used in place of the packer 20 as previously described herein. Compression-set packers can be assembled to one end of an auxiliary pipe (not shown) which can be made from: assembled sections of production tubing; 1¼ inch "work-string"; or can be coiled tubing, any of which of these types of pipe can be types familiar to those skilled in the art. The compression-set packer can be inserted inside the pipe 8 and moved to a depth just above the sloughing 10, the compression-set packer engaged to the wall of the pipe 8, and the auxiliary pipe removed from inside the pipe.

A short length of pipe called a pup joint, shown at 22, is threadedly attached to the lower end of the packer 20. The pup joint 22 can be about three feet long, and is included to protect the packer 20 from the detonation discharge of a pipe cutter 12 which is attached to the lower end of the pup joint 22.

The pipe cutter 12 of the present invention can be a so-called "jet cutter" of a type known in the art and described, for example, in "Pipe Recovery Guide ", Atlas Wireline Services, Houston, Tex., 1987 (p. 24). The jet cutter known in the art is made in a number of different external diameters. The diameter which is selected should be that which is recommended by the jet cutter manufacturer for use in the diameter of the pipe 8 which is to be severed.

Alternatively, the pipe cutter 12 in the present embodiment of the invention can be of a type known in the art as a severing tool, such as one described, for example in "JRC Drill Collar Severing Tool", Jet Research Center, Alvarado, Tex., 1991.

The pipe cutter 12 in the present invention includes a pressure actuated firing head 14 which can be attached to the upper end of the pipe cutter 12. The firing head 14 is adapted to generate an explosive actuation signal upon application of a predetermined pressure to one end of the firing head 14. The operation of the firing head 14 and the pipe cutter 12 according to the present invention will be further explained.

After the packer 20 has been positioned near the depth at which the pipe 8 is to be severed, equipment (not shown separately) in the wireline unit 18, which can be activated by the system operator, sends an electrical actuation signal to the setting tool 17. As is understood by those skilled in the art, actuation of the setting tool 17 causes the packer 20 to become frictionally engaged to the interior of the pipe 8, and also causes the setting tool 17 to become disengaged from the packer 20. The cable 16 can then be withdrawn from inside the pipe 8, and with it the setting tool 17.

Figure 2:
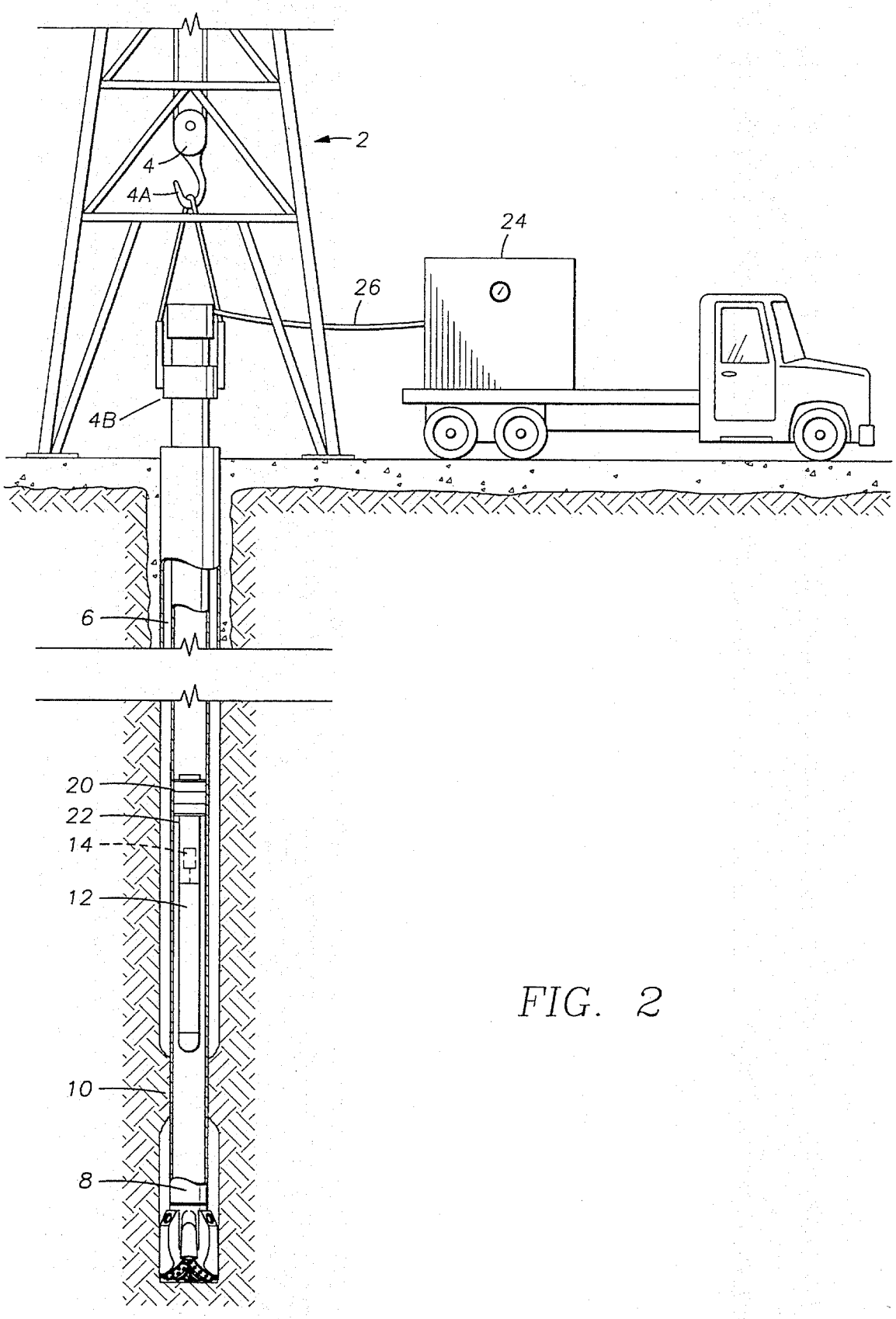
FIG. 2 shows the system of the present invention being initiated by application of pressure to the interior of the pipe.

FIG. 2 shows the packer 20, with the pup joint 22, firing head 14 and pipe cutter 12 attached to the bottom of the packer 20. The packer 20 is shown in FIG. 2 as being positioned inside the pipe 8 near the depth at which the pipe 8 is to be severed, which as previously explained, is located just above the sloughing 10.

After removal of the cable 6 from the interior of the pipe, a pump 24 is then hydraulically connected to the pipe 8 at the earth's surface by means of an hydraulic line and adapter 26. The pump 24 is started and pressure is allowed to build inside the pipe until a predetermined pressure is reached. As is understood by those skilled in the art, the firing head 14 of the present invention is pressure sealed until it is actuated, so that discharge from the pump 24 is prevented from moving past the firing head 14, allowing pressure to build. As will be further explained, when the pressure inside the pipe 8 reaches the predetermined pressure, the firing head 14 generates an explosive actuation signal, which causes the pipe cutter 12 to detonate. Detonation of the pipe cutter 12 severs the pipe 8. After the cutter 12 detonates, pressure which may remain inside the pipe 8 can be bled off by a valve (not shown) which may be attached to the pump 24. The hydraulic line and adapter 26 can then be disconnected from the pipe 8. The pipe 8 can then be removed from the borehole 6 by using the rig 2 to apply appropriate lifting force to the pipe 8.

Figure 3:
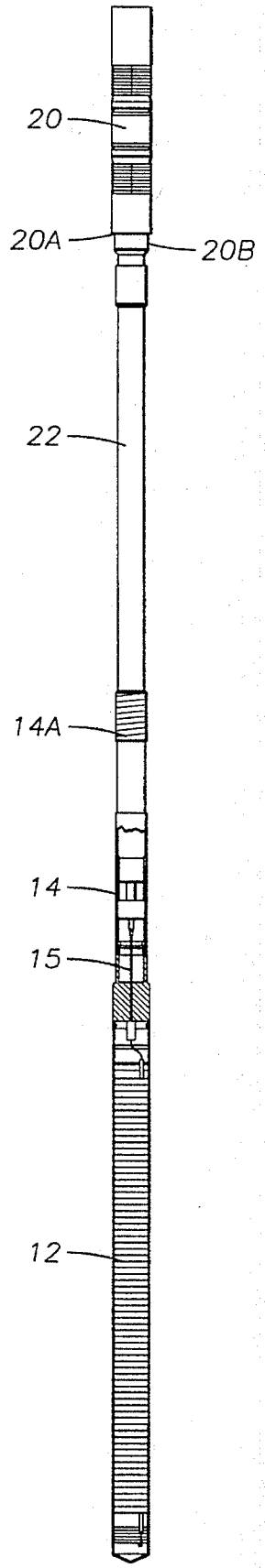
FIG. 3 shows the pipe cutting apparatus of the present invention in more detail.

FIG. 3 shows in more detail the pipe cutter 12, the firing head 14 and the pup joint 22 assembled to the packer 20.

The packer 20 comprises an internally threaded opening 20A at the bottom, to which one end of the pup joint 22 is threadedly connected. If the threads of the pup joint and the packer 20 do not match, then a crossover 20B can be threadedly inserted between the pup joint 22 and the packer 20. The lower end of the pup joint 22 is threadedly engaged to mating threads 14A formed into the uppermost portion of the firing head 14. The firing head 14 can be of a type known in the art and described, for example, in "1 11/16-inch Mighty Mite Absolute Pressure Firing Head With Circulating Valve", Atlas Wireline Services, Houston, Tex., 1989. As is understood by those skilled in the art, the firing head is adapted to generate an explosive actuation signal upon application of the predetermined pressure to the upper end of the firing head.

Alternatively, the firing head 14 can be of a type known in the an which includes a time delay, such as one disclosed for example, in U.S. Pat. No. 4,614,156, issued to Colle et al. The firing head 14 in the Colle patent is adapted to start a pyrotechnic time delay upon application of the predetermined pressure to the upper end of the firing head 14. After the time delay elapses, the firing head 14 generates the explosive initiation signal just as does the previously described "Mighty Mite" firing head 14. As will be apparent to those skilled in the art, using the firing head 14 having the time delay enables the system operator to bleed off the pressure generated by the pump 24 after the firing head 14 is initiated, but before detonation of the pipe cutter 12. In certain cases, bleeding off the pressure before detonation of the pipe cutter 12 can increase safety of the present invention by preventing violent, substantially instantaneous discharge of pressure into the wellbore 6 from inside the pipe 8 upon detonation of the pipe cutter 12.

A detonating cord, shown at 15, extends from the lower end of the firing head 14 to the upper end of the pipe cutter 12. As is understood by those skilled in the art, the detonating cord 15 conducts the explosive actuation signal generated by the firing head 14 to the pipe cutter 12, whereupon the pipe cutter 12 can detonate.

DESCRIPTION OF AN ALTERNATIVE EMBODIMENT

In an alternative embodiment of the invention, the pipe cutter, shown as 12 in FIG. 3, can be substituted by a "chemical cutter". Chemical cutters are known in the art, and are described, for example in "Pipe Recovery Guide ", Atlas Wireline Services, Houston, Tex., 1987 (p. 22). The chemical cutter is assembled to the flowing head 14 in substantially the identical way as is the jet cutter or severing tool type pipe cutter 12 of the first embodiment of the invention. Actuation of the chemical cutter is performed by the explosive actuation signal from the firing head 14 transmitted by means of the detonating cord 15, substantially identically as in the first embodiment of the invention.

The operation of the present embodiment of the invention comprising the chemical cutter is substantially identical to the operation of the first embodiment of the invention comprising the pipe cutter 12.

Other combinations of firing heads, packers and pipe cutters may easily be devised by those skilled in the art without departing from the spirit of the invention disclosed herein. The scope of the invention should be limited only by the claims appended hereto.

What is claimed is:

1. An apparatus for severing a pipe, comprising:

a pressure actuated initiator adapted to generate an actuation signal upon application of a predetermined pressure to said initiator;

a pipe cutter adapted to be actuated by said signal from said initiator; and an annular seal adapted to be substantially immovably engaged to the interior of said pipe, said annular seal operatively attached to said pipe cutter and said initiator so that engagement of said annular seal to the interior of said pipe affixes said pipe cutter and said initiator at a predetermined position inside said pipe, said annular seal adapted to enable pressure communication to said initiator from an upper end of said pipe and adapted to preclude pressure communication through said apparatus.

2. The apparatus as defined in claim 1 wherein said pipe cutter comprises a jet cutter.

3. The apparatus as defined in claim 1 wherein said pipe cutter comprises a chemical cutter.

4. The apparatus as defined in claim 1 wherein said pipe cutter comprises a pipe severing tool.

5. The apparatus as defined in claim 1 wherein:

said initiator further comprises a time delay adapted to start when said predetermined pressure is applied to said initiator and adapted to continue for a predetermined time period; and wherein said initiator is adapted to generate said actuation signal at the end of said predetermined time period.

6. A method of severing a pipe in a borehole comprising the steps of:

lowering a pressure actuated pipe cutting apparatus including a pressure actuated initiator, a pipe cutter and an annular seal into the interior of said pipe;

engaging said annular seal to the interior of said pipe; and applying pressure to the interior of said pipe until an actuation pressure of said initiator is reached, thereby actuating said initiator and said pipe cutter.

7. The method as defined in claim 6 further comprising the step of releasing said pressure from the interior of said pipe during a time delay between actuation of said initiator to actuation of said pipe cutter.

8. The method as defined in claim 6 further comprising the step of applying axial stress to said pipe to cause said pipe to be removed from said borehole.

* * * * *